United States Patent [19]

Reiss

[11] 4,285,031

[45] Aug. 18, 1981

[54] PORTABLE SEARCHLIGHT

[76] Inventor: Hans-Jürgen Reiss, Birkenallee 4, 2000 Schenefeld, Fed. Rep. of Germany

[21] Appl. No.: 867,929

[22] Filed: Jan. 9, 1978

[51] Int. Cl.[3] ..... F21L 7/00

[52] U.S. Cl. ..... 362/205; 362/157; 362/158; 362/183; 362/202

[58] Field of Search ..... 362/157, 158, 183, 178, 362/200–208

[56] References Cited

U.S. PATENT DOCUMENTS

| | | | |
|---|---|---|---|
| 998,895 | 7/1911 | Harvey | 362/200 |
| 2,278,614 | 4/1942 | James | 362/157 |
| 2,444,107 | 6/1948 | Montgomery | 362/158 |
| 2,729,740 | 1/1956 | Davis | 362/205 |
| 3,124,306 | 3/1964 | Schotz | 362/158 |
| 3,787,678 | 1/1974 | Rainer | 362/183 |

*Primary Examiner*—Harold J. Tudor

*Attorney, Agent, or Firm*—Cushman, Darby & Cushman

[57] ABSTRACT

A portable searchlight that can have a plurality of batteries and yet be conveniently held by one hand. The casing is shaped so as to be closely adapted to the shape of the batteries and is constructed from relatively soft materials, at least in the regions between the batteries, so as to provide deformable hand holding areas at those points. Further, the switch for controlling operation of the light is positioned internally of the casing and is operable therethrough.

14 Claims, 11 Drawing Figures

PORTABLE SEARCHLIGHT

The invention relates to a portable searchlight having a casing which closely surrounds circular cylindrical batteries lying close side by side along their generatrices, and which is provided with a reflector.

Particularly for safety, rescue, and security duties, it is important to obtain the best possible artificial lighting in the dark. The lighting power of ordinary pocket and cylindrical torches has hitherto been restricted by the number of batteries utilisable to a power of about 20 Watts.

A portable searchlight is also already known (British Pat. No. 1,006,368) which provides the desired higher lighting power and which is capable of versatile use. This known portable searchlight, however, requires a special handle fastened to a casing, in order to permit simple and easy handling.

Portable searchlights not provided with handles have casings of circular or flattened circular cross-section, so that a hand can almost completely grip around them. The resulting maximum possible cross-sections limit the number of commercially available circular cylindrical non-rechargeable or rechargeable batteries that can be used.

The problem underlying the invention is therefore that of providing a portable searchlight the casing of which can conveniently be held by one hand and which has a high light power.

For the purpose of solving this problem a portable searchlight of the kind first defined above is according to the invention so constructed that the casing encloses at least three batteries whose longitudinal axes lie in cross-section at the apices of an equilateral triangle, and that the portion of the casing which receives the batteries has in the region of the battery surfaces lying on the outside the same centre of curvature as the battery surfaces.

In a preferred embodiment of a portable searchlight of this kind, which has a casing to receive three batteries, the portion of the casing which receives the batteries has in cross-section substantially the shape of a triangle with rounded corners, and along its generatrix each battery is in contact with at least one other battery, but preferably with both other batteries.

In another embodiment of the portable searchlight of the embodiment, which has a casing for receiving more than three batteries, the longitudinal axes of three directly neighbouring batteries lie at the respective apices of an equilateral triangle, while all the triangles that can be formed are preferably equal in size, and as a further development each battery of a group of three neighbouring batteries is in contact along generatrices with the other two batteries of that group.

The portable searchlight of the invention thus does not have a casing of circular or flattened circular cross-section, but a casing which is closely adapted to the shape of the batteries contained in it, the number of which batteries amounts to at least three and which are disposed in cross-section in accordance with the geometry of the closest sphere packing. A shape of casing is thus obtained which, while receiving the same number of circular cylindrical batteries as a casing having a circular or rounded flat cross-section, can be better held in one hand and is better adapted to the anatomy of the hand, so that the casing can be held for a long time without cramp occurring in the hand, whereas with a casing of circular or rounded flat cross-section the hand would have to be spread out substantially more widely—if secure holding were possible at all—for the same number of batteries.

In addition, taking into account the conditions previously mentioned, the casing may also be so shaped that the individual batteries are not in direct contact with one another, but the casing consists of cylindrical parts which have a circular cross-section and each of which closely surrounds a battery, the parts of the casing being joined together and being in contact with one another along generatrices. This results in a similarly optimum handle shape to that of the casing previously described, but its manufacture is considerably more expensive and the total cross-sectional area is rather larger, so that as a rule the previously described shape of casing with the batteries in contact with one another will be preferred unless special purposes require a casing constructed of circular cylindrical parts.

The casing of the portable searchlight according to the invention preferably has a circular cross-section in the region of the reflector, and the part of the casing which receives the batteries is usually made of a different material from that of the reflector.

In order to improve still further the gripping of the casing in the hand in the case of a casing in which the batteries are in contact with one another, the portion of the casing which receives the batteries may have elastic wall parts in which gripping depressions are formed when held by the fingertips of the hand. Gripping depressions or recesses of this kind may optionally also be formed permanently in the casing.

In a preferred embodiment the portion of the casing provided with the reflector is made of aluminium and outside the actual reflector surface has a rough, black surface by which the dissipation of heat is substantially improved.

The switch of the portable searchlight of the invention is preferably completely countersunk in the casing and disposed between the batteries, in order thus to protect it firstly against accidental operation and secondly against damage.

It is expedient to use rechargeable batteries in a portable searchlight according to the invention, and to dispose in the casing the devices for the recharging, including a circuit arrangement for the automatic control of the charging operation. In addition, a circuit arrangement for brightness control, by which the consumption of current can be reduced, may be provided in the casing.

The invention is explained more fully below with reference to the accompanying drawings.

Figure 1:
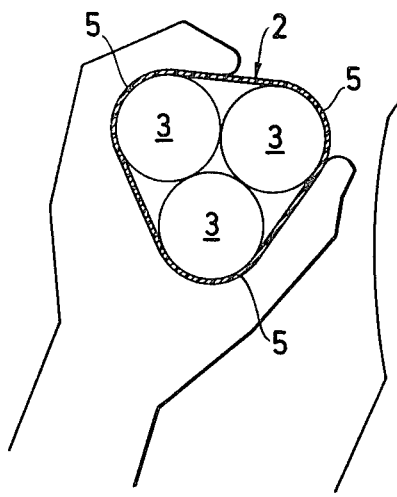
FIG. 1 shows diagrammatically in cross-section the position of three batteries in contact with one another in a portable searchlight according to the invention.

FIG. 1 shows diagrammatically in section the arrangement of three batteries 3 of identical shape in a casing 2 enclosing them. These batteries are conventional rechargeable batteries, such as nickel-cadmium batteries, which have the shape of a circular cylinder. They are in contact by their generatrices so that, as can at once be seen, their longitudinal axes, that is to say the centres of the circles shown in FIG. 1, lie at the apices of an equilateral triangle. These batteries are contained in a casing whose wall 2 can be seen in FIG. 1 and which encloses the batteries 3 so closely that in the position shown in the drawing they are held fast against one another. It can be seen that the casing wall has in cross-section, in the regions 5 adjoining the battery surfaces lying on the outside, the same centre of curvature as the said battery surfaces, and that the respective neighbouring regions 5 are connected together by tangents laid against the battery surfaces, that is to say the casing 2 shown has a substantially triangular cross-section with rounded corner regions.

Figure 3:
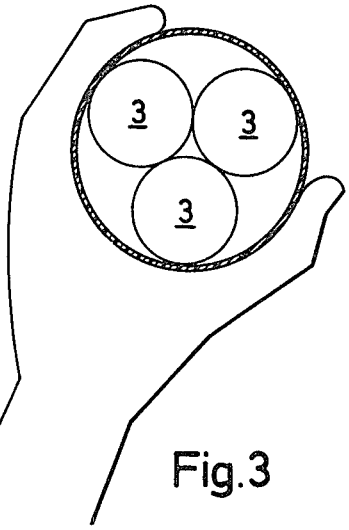
FIG. 3 shows diagrammatically in cross-section the arrangement of three batteries in accordance with FIG. 1, in a casing of circular cross-section.

As can further be seen from FIG. 1, the resulting casing shape is particularly suitable for being held in one hand, so that the hand can be laid around part of the surface of the casing without being opened too wide, thus permitting convenient and secure holding. If this shape of casing is compared with the shape shown in FIG. 3 for a casing which likewise contains three batteries of the same shape as in FIG. 1, and in the same arrangement, and which has a circular cross-section, as is usual, it will at once be seen that for the purpose of holding this casing the hand must be opened substantially more widely, so that there is a greater load on the muscles of the hand and a less secure grip is obtained.

Figure 4:
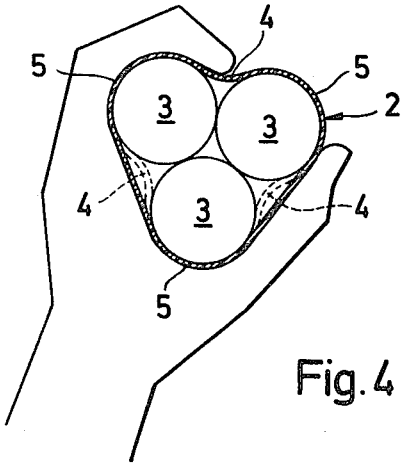
FIG. 4 shows similarly to FIG. 1 a casing having elastically deformable wall parts.
Figure 5:
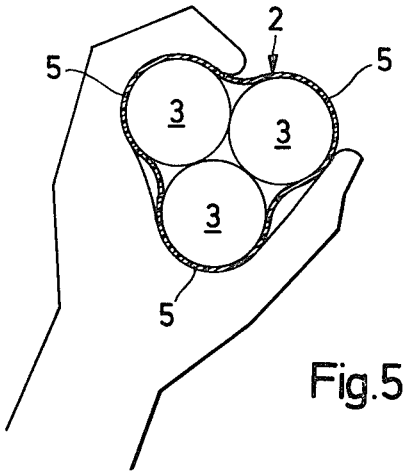
FIG. 5 shows similarly to FIG. 4 a casing in which axially extending gripping depressions are formed.

As shown in FIGS. 4 and 5, the grip can be still further improved with the shape of the casing of the invention. For this purpose, as shown in FIG. 4, a soft elastic material is used at least for the regions 4 lying between the batteries 3, so that these parts of the casing can be depressed by the fingertips in the inward direction between the batteries and gripping depressions can be formed. FIG. 4 shows a region depressed in this manner and also, in broken lines, the gripping depressions formed when the casing is held correspondingly.

In contrast thereto, the gripping depressions shown in FIG. 5 are preformed in the casing, that is to say the casing 2 can be made of relatively rigid material provided with gripping depressions permanently formed in it, this material holding the batteries 3 in the position shown.

Figure 2:
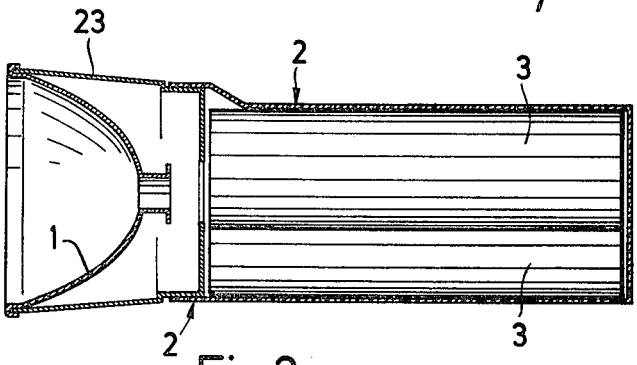
FIG. 2 shows diagrammatically and in greatly simplified form a section through a portable searchlight according to the invention, the batteries being shown in side view.
Figure 8:
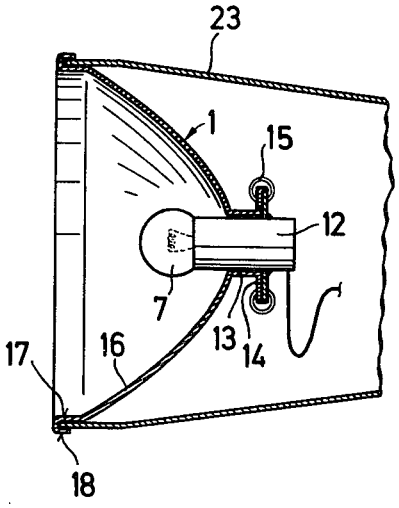
FIG. 8 shows diagrammatically in section the construction of the portion of the portable searchlight shown in FIG. 2 in which the reflector is disposed.
Figure 9:
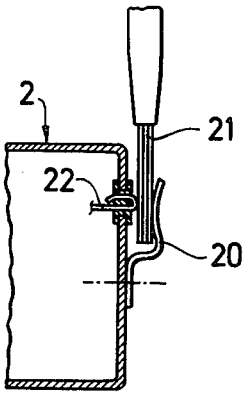
FIG. 9 shows diagrammatically and in a simplified form the charging connections for the batteries of a portable searchlight according to FIG. 2.

FIGS. 2, 8, and 9 show diagrammatically the construction of a portable searchlight according to the invention, which comprises a casing part 2 for holding three rechargeable batteries, which are of identical construction, in accordance with FIG. 1, and a casing part 23 which is of circular cross-section and which serves to hold the reflector 1. It may however be pointed out that it is usually not three batteries but three rows of electrically connected batteries lying one behind the other (not shown) that are used, since ordinary commercially available batteries which can be used for this purpose are relatively short and a higher capacity is obtained by this serial arrangement.

The casing part 2 consists for example of a polycarbonate, or it can be made of a dimensionally stable sheath of plastics material, such as polyethylene, which may optionally be closed at the right-hand end (in FIG. 2) and which is shrunk-on around the batteries 3. Tubes closed at one end are commercially available and are used for example for closing ends of power cables. This casing part 2 is fastened on an annular shoulder on the casing part 23, for example by adhesive bonding, shrinking, or screw connection.

The casing part 23, which contains the reflector 1, is made for example of aluminium and has a roughened black outside surface in order to achieve the best possible dissipation of heat. The parabolic region 16 of the region 16 of the reflector 1 is followed in the forward direction by a cylindrical portion 17 which has a bent-back flange 18. With the aid of this cylindrical portion it is possible for the entire reflector simply to be pushed into the case part 23, which is cylindrical in shape at the front end, so that the reflector is held resiliently, while the flange 18 prevents the reflector from being pushed too far into the casing part 23. A socket 12 is inserted into the inner cylindrical portion 13 of the reflector, this socket bearing by means of a disc against a flange 14 on the reflector and being held in the reflector by means of a circular segmental metal spring 15. A lamp 7 is inserted into the socket, and an electric cable leads to the batteries in a customary manner which is not illustrated. Through this cable connection it is possible to detach the reflector and socket from the casing part 23, in order for example to change the lamp or make other repairs.

At the end of the casing part 2 remote from the casing part 23 an arrangement is provided in the usual case for the purpose of charging the batteries, and in FIG. 9 two contacts 20 and 22 are indicated diagrammatically, the contact 20 consisting of a spring element; between these contacts can be inserted a connection plate 21 whose mutually opposite sides can be connected to the poles of a voltage source.

Through a construction of the portable searchlight of this kind it is possible to accommodate in one part of the casing—the casing part 2—for example three ordinary commercially available rechargeable batteries which have a diameter of about 33 mm, or three rows of such batteries, in such a manner that the said casing part can be held securely and in a simple manner by one hand without thereby too heavily loading the hand. With an overall length of the portable searchlight of about 35 cm it is then possible to use lamps of a power of more than 50 Watts, and the heat resulting from this high power is without difficulty dissipated by the casing part 23, which is made of aluminium and has a roughened black outside surface.

Figure 6:
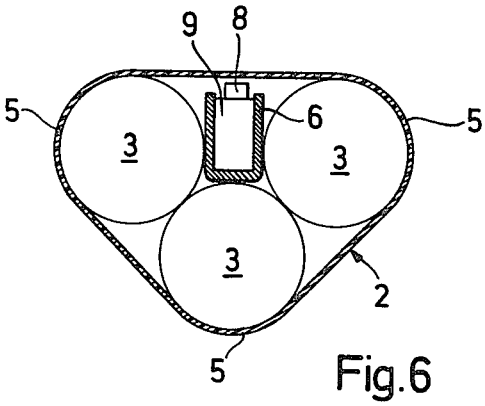
FIG. 6 shows diagrammatically, similarly to FIG. 1, a modified arrangement of the batteries.

If the circuit for the charging of the batteries and also the switches for switching the lamp on and off and, optionally, a brightness control system including an appropriate switch are to be accommodated in the casing part 2 which contains the batteries, an arrangement of the kind shown in FIG. 6 can be selected, in which two of the three batteries are moved slightly apart, so that an isosceles triangle is formed, that is to say in cross-section the tangent connecting the regions 5 of these two batteries is slightly longer than the tangents connecting the other regions 5. In the free space thus formed is accommodated a U-shaped metal support 6, against whose outer walls the two batteries 3 which have been moved further apart will bear and in which the rectifier circuit 10 and charging and brightness control circuits, in the form of a commercially available integrated circuit in modular form (module 9)—such as one made by Texas Instruments or RCA, including a brightness control switch and the on-off switch 8 are contained (see FIG. 7), while the connections 11 lead to contact corresponding to the contacts 20 and 22 in FIG. 9. In this case it is obviously necessary for the wall of the casing part receiving the batteries 3 to be elastic at least in the region of the tangent between the batteries 3 which have been moved apart, so that the on-off switch 8 and/or the brightness control switch can be operated by suitably deforming this region of the wall.

Figure 7:
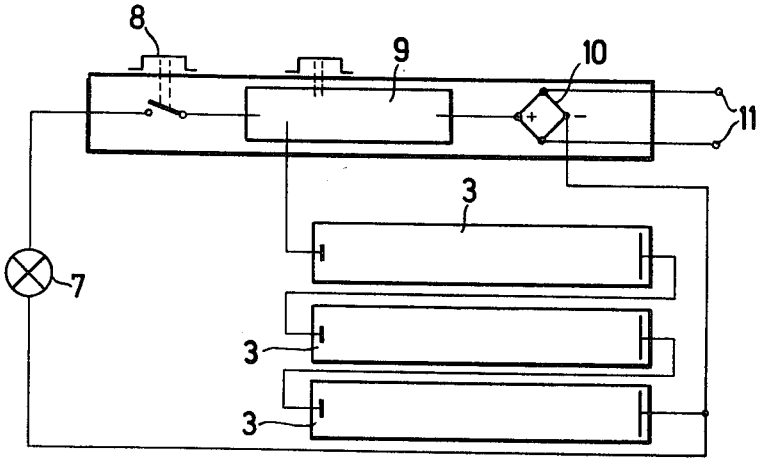
FIG. 7 shows diagrammatically the circuit arrangement for switching on and off the portable searchlight according to FIG. 2 and also for charging its batteries.

It may be pointed out that the circuit arrangement shown in FIG. 7, which can be used for this purpose, is generally known, so that a detailed description is not necessary.

Figure 10:
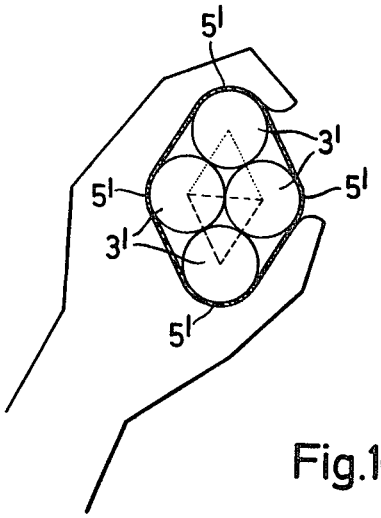
FIG. 10 shows similarly to FIG. 4 a casing according to the invention which contains four batteries.

While the portable searchlight according to the examples of embodiment described so far contained three batteries, it is also possible, as shown in FIG. 10, for four circular cylindrical batteries 3'—or four rows of such batteries—to be accommodated in a casing in such a manner that a particularly advantageous casing construction is obtained, which enables the portable searchlight to be held securely and in a simple manner in one hand without tiring. In this case the batteries are once again disposed in cross-section in accordance with the geometry of the densest sphere packing, so that the longitudinal axes of the batteries—that is to say the centres of the circles shown in FIG. 10—of three neighbouring batteries 3' lie at the respective apices of an equilateral triangle, as indicated in the once case by a triangle in dotted lines and in the other case by a triangle in dashed lines. In this arrangement one battery of a group of three batteries disposed in an arrangement of this kind is in contact along its generatrices with the other two batteries of that group.

In this case also the casing embraces the batteries very closely, and the casing regions 5', which adjoin the outer surfaces of the batteries, have the same centre of curvature as the said surfaces, while neighbouring regions 5' are connected together by tangents to the battery surfaces.

In the case of a portable searchlight having four batteries ordinary commercially available rechargeable batteries, particularly nickel-cadmium batteries, can likewise be used without difficulty, namely for example those having a diameter of about 24 mm.

Figure 11:
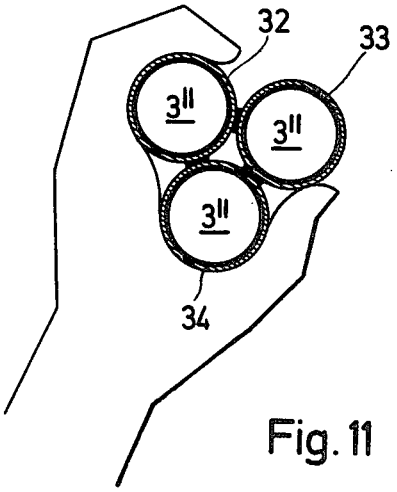
FIG. 11 shows diagrammatically in section a casing of a portable searchlight comprising three circular cylindrical casing parts connected together.

FIG. 11 shows in section an example of embodiment in which the casing consists of three parts 32,33,34, which are tubular and have a circular cross-section. Each of these casing parts closely surrounds a circular cylindrical battery 3'' or a row of such batteries, and the casing parts are in contact with one another along their generatrices, the arrangement being the same as that of the batteries in FIG. 1. The connection along the generatrices can for example be effected by welding or soldering, and it is also possible to provide corresponding connecting elements in the end regions of the casing parts.

As already mentioned above, the solution shown in FIG. 11 is more expensive than those solutions in which the batteries are enclosed in a single casing, but a more expensive construction of this kind may be advantageous for certain applications.

I claim:

1. A portable searchlight having a reflector housing, a casing which conforms substantially to at least three circular, cylindrical, batteries positioned adjacent one another along their generatrices so that said casing receiving said batteries has the same center of curvature as the battery surface, said casing having soft, elastic portions at least in the regions between the batteries to provide deformable hand holding areas in the casing, said casing serving to maintain said batteries in positions where the longitudinal axes lie, in cross-section, at the apices of an equilateral triangle, said casing being hermetally sealed to said reflector housing and switch means for controlling actuation of said searchlight, said switch means being positioned internally of said casing and along the side thereof said batteries, so as to be operable through said casing.

2. A portable searchlight according to claim 1, wherein each battery is in contact with at least one other battery along their generatrices.

3. A portable searchlight according to claim 1, wherein said casing encloses more than three batteries, with the longitudinal axes of three directly adjoining batteries lying at the respective apices of an equilateral triangle.

4. A portable searchlight according to claim 3, wherein all triangles which can be formed are equal in size.

5. A portable searchlight according to claim 3, wherein in that each battery of a group of three neighbouring batteries is in contact along generatrices with the other two batteries of said group.

6. A portable searchlight according to claim 1 wherein the casing is composed of a plurality of cylindrical casing parts which have a circular cross-section and each of which closely surrounds a battery.

7. A portable searchlight according to claim 1 wherein the casing has a circular cross-section in the region of the reflector (1).

8. A portable searchlight according to claim 1 wherein said deformable hand holding areas extend in an axial direction, along the wall of said casing.

9. A portable searchlight according to claim 1 wherein the casing surrounding the reflector is made of aluminium and has a rough black outer surface.

10. A portable searchlight according to claim 1 wherein said switch means is completely countersunk in said casing and disposed between the batteries.

11. A portable searchlight according to claim 1, further including control circuit means for controlling the charging operation of said rechargeable batteries.

12. A portable searchlight according to claim 1 wherein said switch means includes control means for providing a plurality of brightness levels for said searchlight.

13. A portable searchlight as in claim 1 wherein said casing is comprised of soft, elastic material.

14. A portable searchlight as in claim 1 wherein said batteries are rechargeable.

* * * * *